US006942474B2

(12) United States Patent
Tsuchiya

(10) Patent No.: US 6,942,474 B2
(45) Date of Patent: Sep. 13, 2005

(54) SCROLL FLUID MACHINE

(75) Inventor: Masaru Tsuchiya, Yokohama (JP)

(73) Assignee: Anest Iwata Corporation, Yokohama (JP)

( * ) Notice: Subject to any disclaimer, the term of this patent is extended or adjusted under 35 U.S.C. 154(b) by 0 days.

(21) Appl. No.: 10/847,215

(22) Filed: May 17, 2004

(65) Prior Publication Data

US 2004/0234405 A1 Nov. 25, 2004

(30) Foreign Application Priority Data

May 23, 2003 (JP) ..... 2003-146609

(51) Int. Cl.[7] ..... F03C 2/00

(52) U.S. Cl. ..... 418/55.3; 418/55.1; 418/55.4; 418/55.6; 464/102

(58) Field of Search ..... 418/55.6, 55.1, 418/55.3, 55.4, 5, 60; 464/102

(56) References Cited

U.S. PATENT DOCUMENTS 4,424,010 A * 1/1984 McCullough ..... 418/60

6,425,746 B1 * 7/2002 Mori et al. ..... 418/55.2

FOREIGN PATENT DOCUMENTS

JP 04269301 A * 9/1992 ..... F04C/18/02

* cited by examiner

*Primary Examiner*—Theresa Trieu
(74) *Attorney, Agent, or Firm*—Davis & Bujold, P.L.L.C.

(57) ABSTRACT

A first fixed scroll has a first fixed wrap, and a first orbiting scroll has a first orbiting wrap. The first orbiting scroll is rotatably mounted to an eccentric portion of a driving shaft. The first fixed wrap is engaged with the first orbiting wrap to form a first compression chamber in which pressure is changed towards the center of the first orbiting scroll. A second fixed scroll has a second fixed wrap and a second orbiting scroll has a second orbiting wrap which is engaged with the second fixed wrap. The first orbiting scroll is connected to the second orbiting scroll by a pin inserted a partition wall between the first and second orbiting scrolls, thereby rotating the first orbiting scroll together with the second orbiting scroll when the first orbiting scroll is driven by the driving shaft via the eccentric portion.

5 Claims, 2 Drawing Sheets

SCROLL FLUID MACHINE

BACKGROUND OF THE INVENTION

The present invention relates to a scroll fluid machine and especially relates to a scroll fluid machine such as a scroll vacuum pump, a scroll compressor, a scroll expander or a scroll blower, in which a fixed wrap of a fixed scroll in a housing is engaged with an orbiting wrap of an orbiting scroll rotatably mounted to an eccentric portion of a driving shaft, the orbiting scroll being eccentrically revolved by the driving shaft so that a gas sucked through the circumference or center is pressurized or depressurized as it moves toward the center or circumference and discharged.

In the scroll fluid machine which is known among persons skilled in the art, an orbiting scroll rotatably mounted to an eccentric portion of a driving shaft has an orbiting end portion, and a fixed scroll has a fixed end portion. An orbiting wrap of the orbiting end portion is engaged with a fixed wrap of the fixed end portion to form a sealed chamber, and there is provided a self-rotation-preventing mechanism for the orbiting scroll.

By the eccentric portion and the self-rotation-preventing mechanism, the orbiting scroll is eccentrically revolved, and according to a direction of revolving, the volume of the sealed chamber is gradually decreased toward the center or increased toward the circumference, so that fluid sucked through the circumference is introduced to the center under pressurizing or fluid sucked through the center is discharged through the circumference under depressurizing.

In factories and various workshops, various kinds and capabilities of scroll fluid machines are placed depending on the contents of working. A plurality of different scroll fluid machines are usually disposed in relevant factories, taking account of the type and capability expected in use. However, it is not economical in fixing cost, occupation area, the rate of operation and maintenance.

BRIEF DESCRIPTION OF THE DRAWINGS

The features and advantages of the invention will become more apparent from the following description with respect to embodiments as shown in appended drawings wherein.

DETAILED DESCRIPTION OF PREFERRED EMBODIMENTS

Figure 1:
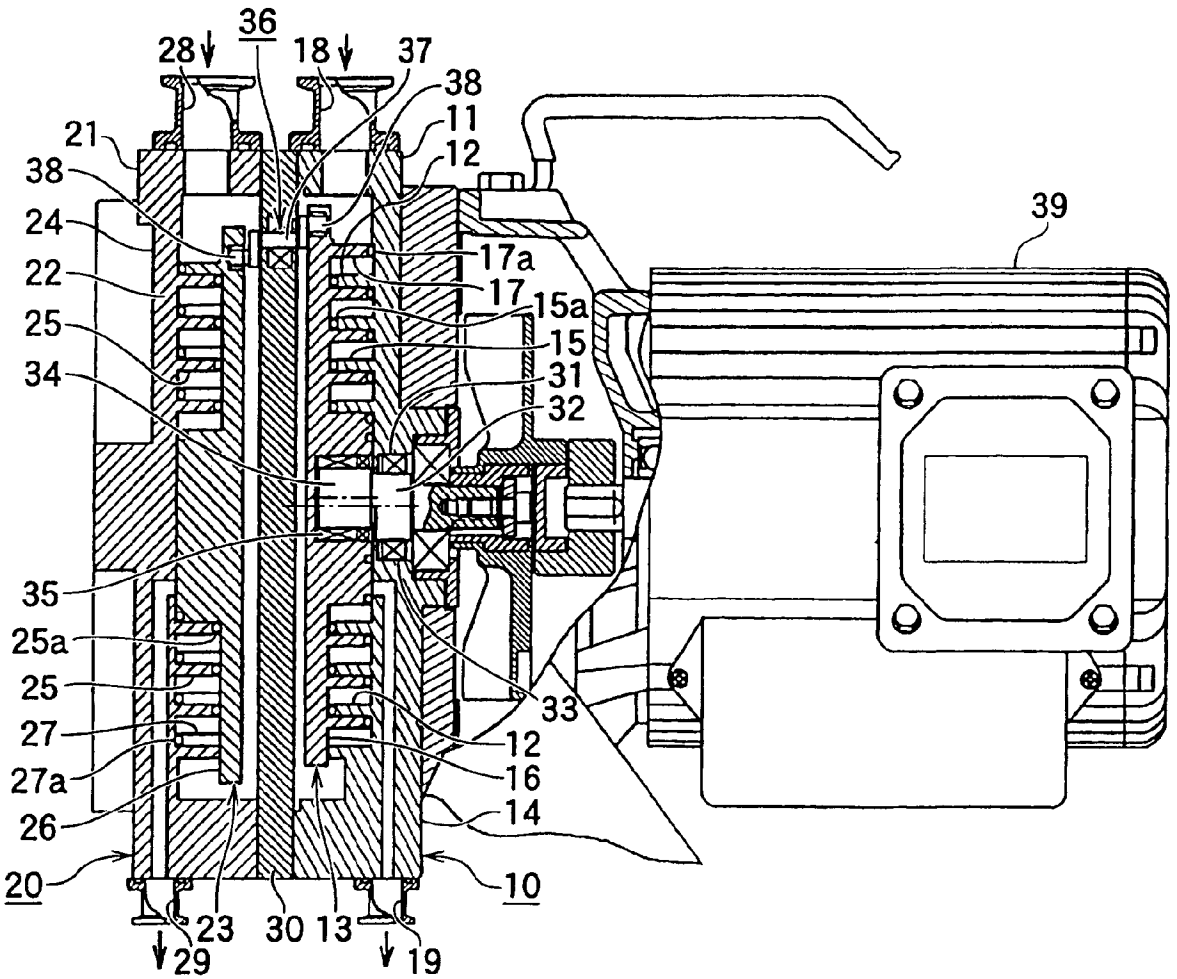
FIG. 1 is a vertical sectional side view of one embodiment of a scroll fluid machine according to the present invention.

Numerals 10,20 denote first and second scroll engagement actuating portions having the same axis, and are respectively provided in first and second box-like housings 11,21 which faces each other at both sides of a partition wall 30, having first and second fixed scrolls 12,22 and first and second orbiting scrolls 13,23 which are engaged with each other.

Scroll engagement actuating portions 10,20 are known and will be described as below. In the first and second fixed scrolls 12,22, spiral fixed wraps 15,25 are projected on the inner surface of end portions 14,24 which are outer walls of the first and second housings 11,21, and tip seals 15*a*,25*a* are engaged over the top of the fixed wraps 15,25. In the first and second orbiting scrolls 13,23, orbiting wraps 17,27 are projected on the outer surfaces of orbiting end portions 16,26 to engage with the fixed wraps 15,25. Tip seals 17*a*,27*a* are engaged over the top of the orbiting wraps 17,27.

Sucking bores 18,28 are formed on the circumference and discharge bores 19,29 are formed on the fixed end portion 14,24 of the housings 11,21 to extend from the middle.

In an axial bore 31 at the center of the fixed end portion 14 of the first housing 11, a driving shaft 32 is rotatably disposed via a bearing 33, and an eccentric portion 34 at the end of the driving shaft 32 is rotatably mounted via a bearing 35 at the center of an orbiting end portion 16 of the orbiting scroll 13 of the first scroll engagement actuating portion 10.

The orbiting end portions 16,26 of the first and second scroll engagement actuating portions 10,20 are connected to each other by three both-side pin-crank-type self-rotation-preventing mechanisms 36 rotatably mounted and spaced equally on the circumference of the partition wall 30. Specifically, in the both-side pin-crank-type self-rotation-preventing mechanisms 36, a double-crank shaft 37 is rotatably mounted in the partition wall 30 and eccentrically projecting pins 38,38 are rotatably mounted in the orbiting end portions 16,26.

The scroll engagement actuating portions 10,20 have the same size and volume, but may have different size, volume or function.

When the driving shaft 32 is driven by an electric motor 39, the orbiting end portion 16 of the first scroll engagement actuating portion 10 is eccentrically revolved and radial size of space between the fixed and orbiting wraps 15 and 17 changes, so that the central portion of the housing 11 is gradually depressurized and a gas sucked through the sucking bore 18 is discharged through a discharge bore 19 at the center.

The eccentric revolution of the orbiting end portion 16 of the first scroll engagement actuating portion 10 is transmitted to the orbiting end portion 26 of the second scroll engagement actuating portion 20 via the pin-crank-type self-rotation-preventing mechanism 36, so that the orbiting end portion 26 is eccentrically revolved as well, and a gas sucked through the sucking bore 28 is discharged through a discharge bore 29 at the center.

By the single driving shaft 32, two scroll fluid machines are simultaneously driven, which is economical and the external diameters of the scroll engagement actuating portions 10,20 can be reduced in spite of its evacuating volume.

In case that large volume is not required, the scroll engagement actuating portions 10,20 have different volume as above to provide various volume of scroll machines, which is advantageous.

To provide different volumes of the first and second scroll engagement actuating portions 10,20, for example, the following measures are taken:

1) to make difference in wrap windings of the scroll engagement actuating portions 10,20;

2) to make difference in height of the scroll engagement actuating portions 10,20; and 3) make difference in eccentricity of an eccentric portion 34 of the driving shaft 32 and a pin 38 of a double-crank shaft 37 of the pin-crank-type self-rotation-preventing mechanism 36.

Figure 2:
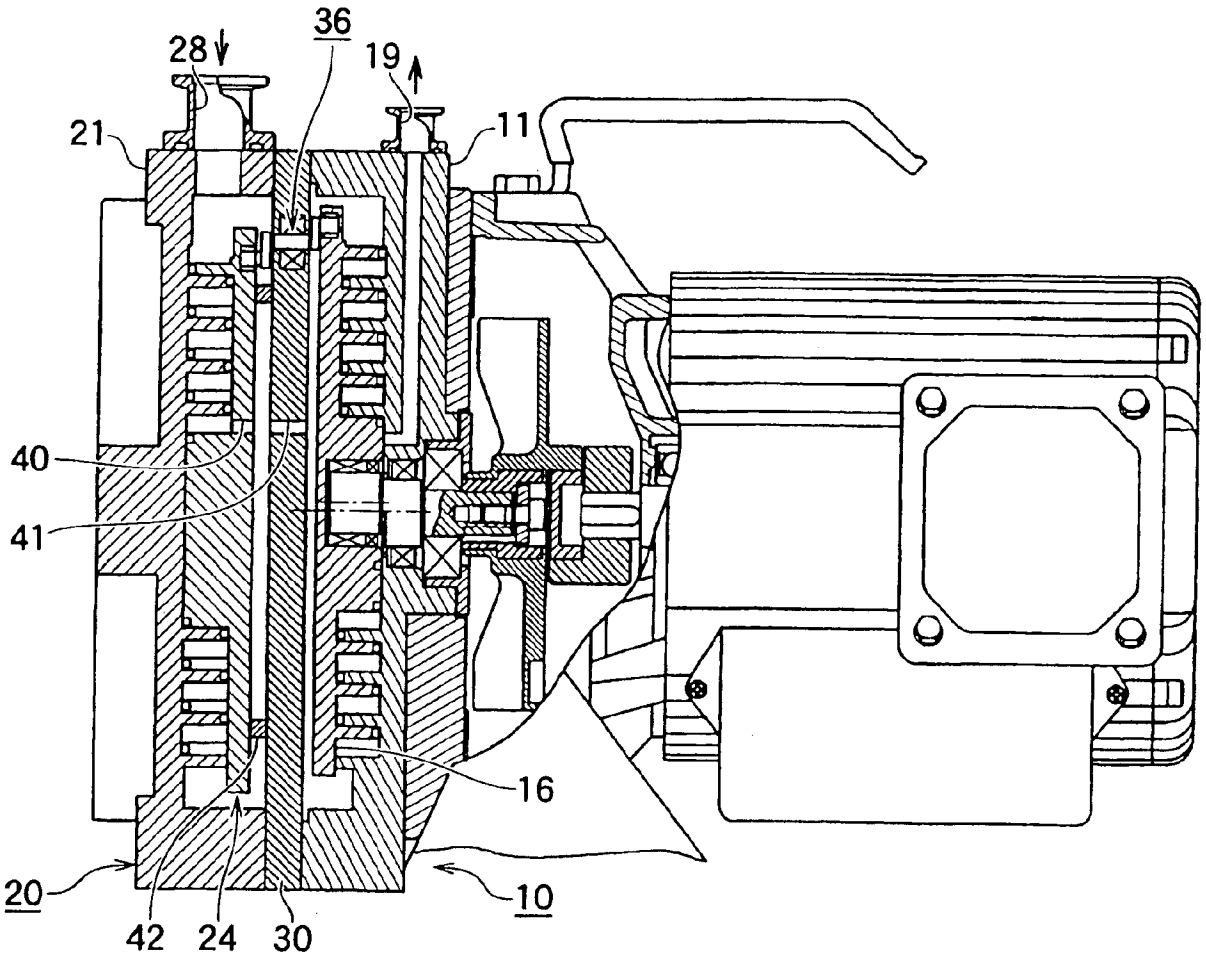
FIG. 2 is a vertical sectional view of another embodiment of a scroll fluid machine according to the present invention.

FIG. 1 Illustrates the first and second scroll engagement actuating portions 10,20 are provided separately, but may be connected as shown in FIG. 2.

Axial bores 40, 41 are formed near the center of an orbiting end portion 26 of a second scroll engagement actuating portion 20 similar to one in FIG. 1 and a partition wall 30, and an annular seal 42 is provided between the orbiting end portion 24 and the partition wall 30 around the bores 40, 41. In a second housing 21 only a sucking bore 28 is formed without a discharge bore, while only a discharge bore 19 is provided without a sucking bore. The other members than the above are the same as those in FIG. 1, and numeral and description thereof are omitted except especially required ones.

In FIG. 2, when a driving shaft 32 is rotated, first and second orbiting scrolls 13,23 are eccentrically revolved at the same time, so that a gas sucked through the sucking bore 28 of the second housing 21 is compressed as it moves toward the center. Then, the gas is transferred with compression via the bores 40,41 and around the orbiting end portion 16, moved to the center via the circumference of the first scroll engagement actuating portion 10, and discharged through the discharge bore 19.

Thus, even if the diameters of the scroll engagement actuating portions 10,20 are small, high-pressure compression and large volume discharge can be achieved.

In the present invention, the positions of the sucking bores 18,28 and discharge bores 19,29 of the first and second scroll engagement actuating portions 10,20 may be changed variously.

In this invention, one of the first engagement actuating portions 10,20 is used for pressurizing, while the other is used for depressurizing.

The foregoing merely relates to embodiments of the invention. Various changes and modifications may be made by a person skilled in the art without departing from the scope of claims wherein:

What is claimed is:

1. A scroll fluid machine comprising:

a driving shaft;

a first scroll engagement actuating portion comprising a first orbiting scroll and a first fixed scroll, and the first orbiting scroll being connected to the driving shaft and engaged with the first fixed scroll;

a second scroll engagement actuating portion comprising a second orbiting scroll and a second fixed scroll engaged with the second orbiting scroll, and said first orbiting scroll being connected to said second orbiting scroll to revolve together when the first orbiting scroll is driven by the driving shaft; and the pin-crank-type self-rotation-preventing mechanism comprising a double-crank shaft inserted in a partition wall and provided with a bearing, and the pin-crank-type self-rotation-preventing mechanism having a first pin connected to the first orbiting scroll and a second pin connected to the second orbiting scroll.

2. A scroll fluid machine as claimed in claim 1, wherein the partition wall is located between the first and second scroll engagement actuating portions, and the pin-crank-type self-rotation-preventing mechanism passes through the partition wall such that the first and second scroll engagement actuating portions revolve together when the first orbiting scroll is driven by the driving shaft.

3. A scroll fluid machine as claimed in claim 2, wherein the driving shaft has eccentric portion at one end, the first orbiting scroll is rotatably mounted on the eccentric portion of the driving shaft, the first fixed scroll has a first fixed wrap, the first orbiting scroll has a first orbiting wrap engaged with the first fixed wrap to form a first compression chamber in which pressure is forced towards a center of the first orbiting scroll when the first orbiting scroll is eccentrically revolved by the driving shaft via the eccentric portion, the second orbiting scroll is revolved together with the first orbiting scroll by the pin-crank-type self-rotation-preventing mechanism, the second orbiting scroll has a second orbiting wrap which is engaged with a second fixed wrap of the second fixed scroll to form a second compression chamber in which pressure is forced towards a center of the second orbiting scroll when the second orbiting scroll is revolved together with the first orbiting scroll.

4. A scroll fluid machine as claimed in claim 2, wherein a first sucking bore, for introducing a first gas into the first scroll engagement actuating portion, is formed through a circumference of a first fixed end portion of a housing; a first discharge bore, for discharging the first gas, is formed at portion near a center of the first orbiting scroll; a second sucking bore, for introducing a second gas into the second scroll engagement actuating portion, is formed through a circumference of a second fixed end portion of the housing; and a second discharge bore, for discharging the second gas, is formed at portion near a center of the second orbiting scroll.

5. A scroll fluid machine as claimed in claim 2, wherein a first through bore is formed through the partition wall, a second through bore is formed through the second orbiting scroll near a center of the second orbiting scroll, a gas, introduced through a sucking bore of the second scroll engagement actuating portion, flows through the first and second through bores to the first scroll engagement actuating portion and is discharged through a discharge bore.

* * * * *